US007243448B1

(12) United States Patent
Zuaro

(10) Patent No.: US 7,243,448 B1
(45) Date of Patent: Jul. 17, 2007

(54) FLASHER

(76) Inventor: Steven Zuaro, 1600 Woodland Dr. #8207, Rockledge, FL (US) 32955

( * ) Notice: Subject to any disclaimer, the term of this patent is extended or adjusted under 35 U.S.C. 154(b) by 170 days.

(21) Appl. No.: 10/688,102

(22) Filed: Oct. 17, 2003

(51) Int. Cl.
*G09F 11/00* (2006.01)

(52) U.S. Cl. ..... 40/491; 40/488

(58) Field of Classification Search ..... 40/508, 40/509, 513, 488, 343, 487, 491, 481, 476
See application file for complete search history.

(56) References Cited

U.S. PATENT DOCUMENTS

| | | | | | |
|---|---|---|---|---|---|
| 209,158 | A | * | 10/1878 | Carlisle | 40/375 |
| 258,635 | A | * | 5/1882 | Elliott | 434/150 |
| 357,677 | A | * | 2/1887 | Lykens | 434/413 |
| 453,711 | A | | 6/1891 | Molin | |
| 627,396 | A | | 6/1899 | Daly | |
| 876,278 | A | * | 1/1908 | Mayerle | 40/491 |
| 2,691,837 | A | * | 10/1954 | Gove | 40/643 |
| 3,659,365 | A | | 5/1972 | Eaton | 40/16 |
| 3,719,000 | A | * | 3/1973 | Finger | 40/609 |
| 3,991,495 | A | * | 11/1976 | Wilson | 40/375 |
| 4,835,889 | A | | 6/1989 | McClymonds | 40/611 |
| 4,876,811 | A | * | 10/1989 | Peltz | 40/586 |
| 5,608,979 | A | | 3/1997 | Johnson | 40/491 |
| 5,913,615 | A | | 6/1999 | Rellinger | 40/491 |
| 6,139,331 | A | * | 10/2000 | Owen | 434/408 |
| 6,347,468 | B1 | | 2/2002 | Mohamed | 40/564 |
| 6,553,704 | B1 | | 4/2003 | Pigg | 40/734 |

FOREIGN PATENT DOCUMENTS

| | | | |
|---|---|---|---|
| EP | 370393 | A2 | 5/1990 |

* cited by examiner

*Primary Examiner*—Cassandra Davis
(74) *Attorney, Agent, or Firm*—Brian S. Steinberger; Law Offices of Brian S. Steinberger, P.A.

(57) ABSTRACT

Portable handheld sign devices and methods of use that allow a frame holder of store plural indicia covered sign boards therein, and include front facing and rear facing signboards. U-shaped frames with indicia covered signboards can be slid down to extend beneath the frame holder, and U-shaped frames with indicia covered signboards can be positioned in side channel slots to hold and support sign boards above the frame holder. The stored u-shaped frames and the front and rear signs on the frame holder also have hingedly attached signs thereon that can move from sandwiched overlapping positions to be swung out exposing indicia on the signs. The frame holder can go from showing one side board up to nine exposed signboards. The frame holder can be supported and held in one hand by a single pole handle, or held up by side lip edges.

7 Claims, 23 Drawing Sheets

FLASHER

BACKGROUND AND PRIOR ART

Fans of sporting events such as those that attend football games, baseball games, and the like, often wish to express their loyalty and goodwill to their respective teams by holding up small signs and the like. However, the handheld signs are generally limited to cardboard or paper signs that have a one time user, and are difficult to hold. Weather conditions, such as rain, often ruin these signs. Other types of handheld signs have included small paddles, and the like, that are restricted to showing one message on a front or the paddle sign, and at most a second message on a rear side of the paddle sign. None of these devices allow for easy and simple modifications to allowing plural signs to be interchanged by the same device.

Various types of signs have been used and proposed over the years for sending messages to third parties. See for example, U.S. Pat. Nos. 453,711 to Molin; 624,396 to Daly; 3,659,365 to Eaton; 4,835,889 to McClymonds; 5,608,979 to Johnson; 5,913,615 to Rellinger; 6,553,704 to Pigg; and European Patent EPO000370393 to Marchon. However, these patented devices are generally limited to signs that must be permanently or fixably mounted or positioned on a flat support surface in order to work. These devices are not intended to and are not generally capable of easily being carried by a user since they would be both cumbersome to use, too large to be held, and too heavy to held by a user. Additionally, most of these sign devices would be to heavy to be held in one hand by a user over long periods of time, such as for several hours during a sporting event. In addition, these devices are generally intended to be used indoors, or would require additional protection such as the need to be sealed and weather conditioned to be used outdoors.

U.S. Pat. No. 6,347,468 to Mohamed describes a "portable illuminated sign . . . ", title, with two side handles. However, this device requires both hands or a user to support the sign. Additionally, this sign device requires electrical power supply such as batteries, and the like, and fluorescent tubes to work. Thus, this device would be to expensive to manufacture and produce for most fans to use. Additionally, this device would be too heavy to lift and hold for extended periods of time. Additionally, the two hand requirement would not be practical or easy for the user to hold the signage.

Furthermore, many of these patented sign devices such as the Johnson and Mohamed would be too elaborate and expensive to manufacturer, and would not be suitable to be held by a user.

These patented devices would not be generally practical for use by spectators and fans at outdoor sporting events.

Thus, the need exists for solutions to the above problems with the prior art.

SUMMARY OF THE INVENTION

The first objective of the present invention is to provide a portable sign device and method of use that allows for one hand of a user to hold and support.

The second objective of the present invention is to provide a portable sign device and method of use having interchangeable signs that is inexpensive to produce and sell.

The third objective of the present invention is to provide a portable sign device and method of use can be easily supported and held by a user over long periods of time, such as for several hours, or more.

The fourth objective of this invention is to provide a portable sign device and method of use that can be used outdoors, without being damaged by weather conditions.

The fifth objective of the present invention is to provide a portable sign device and method of use that does not require power, such as electricity to operate, or multiple moving parts, such as gears, and the like, to work.

The sixth objective of the present invention is to provide a portable sign device and method of use that allows the user to slide signs up and down from a main frame.

The seventh objective of the present invention is to provide a portable sign device and method of use that allows the user to hingedly fold signs over other signs so that plural signs can be stored and used with one sign device.

A preferred embodiment of the portable interchangeable sign device and methods of use can include a hollow main frame having a first pair of longitudinal interior channels facing one another, the main frame having at least one of a top opening and a bottom opening, a first sign having visible indicia thereon for being slidable within the first pair of longitudinal interior channels from a storage position inside of the frame to an exterior position outside of the frame, and a handle attached to the frame for allowing the sign device to be supported and held by at least one hand of a user.

The main frame can include plural channels inside for allowing more than one sign to be slidably stored inside. The signs be extended above or below, or both above and below the main frame.

The main frame can include a single longitudinal handle extending below so that a user can hold the frame in one hand. Additionally, or alternatively, exterior side lip edges on the frame can be used for allowing the user to hold the frame with two hands.

The signs can be supported inside of U-shaped frames, with the frames having upper side edge tabs that slide within longitudinal channels inside of the main frame to that signs can be extended below and exposed under the main frame. The U-shaped frames can include lower side edge tabs that fit within narrow depth slots in the main frame so that signs can be extended above and exposed above the main frame.

Additional embodiments have hinged signs that attach to anyone of the front wall, the rear wall, the other U-shaped frames. The hinged signs can move from stacked type positions to swing outward in front of the main frame, above the main frame, and/or below the main frame so that up to nine signs with indicia thereon can be exposed.

The invention can go from having one sign on the frame holder up to nine signs all exposed all being attached to the same one frame holder.

Further objects and advantages of this invention will be apparent from the following detailed description of the presently preferred embodiments which are illustrated schematically in the accompanying drawings.

BRIEF DESCRIPTION OF THE FIGURES

FIG. 7 shows the sign device of the preceding figures with the signs separated there from.

FIG. 9 is a side view of the sign device of FIG. 8 with the top sign separated there from.

DESCRIPTION OF THE PREFERRED EMBODIMENTS

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

Figure 1:
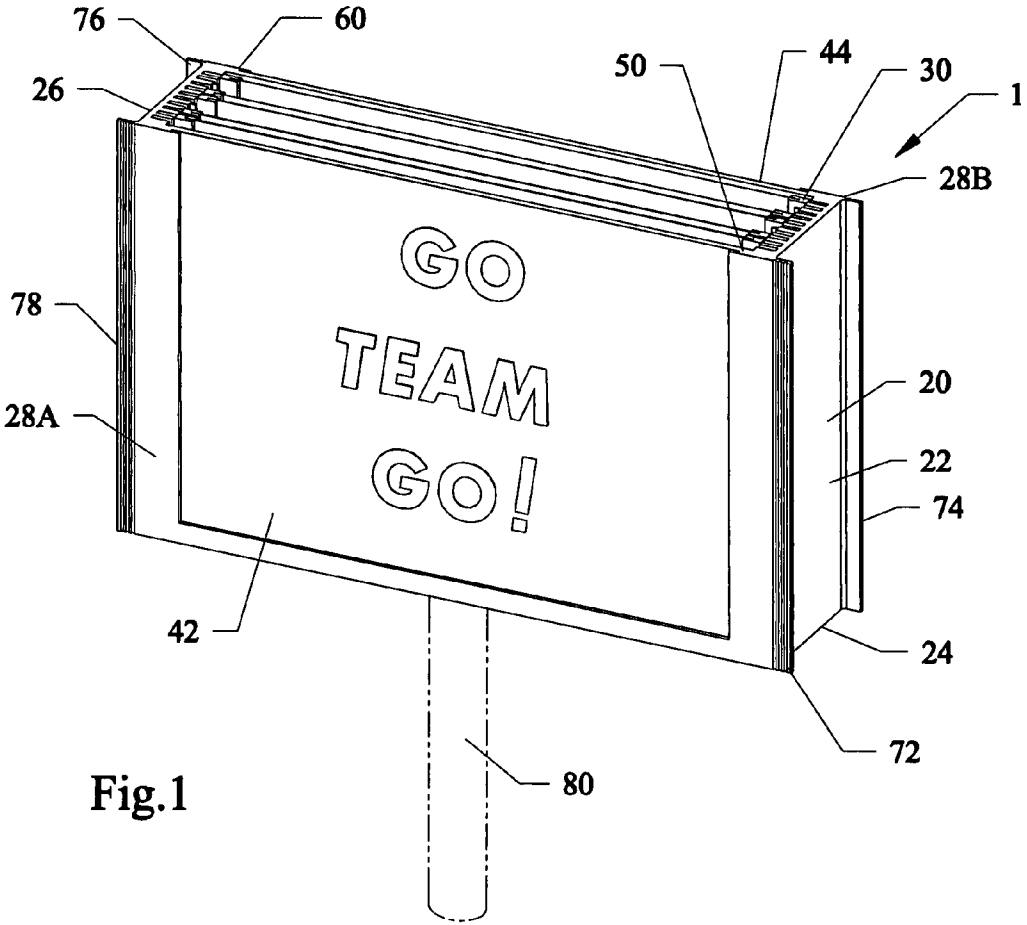
FIG. 1 is a perspective view of a first embodiment sign device.

FIG. 1 is a perspective view of a first embodiment sign device 1 that includes a card frame holder 20 having right side wall 22, left side wall 26, front U-shaped wall 28A, and rear U-shaped wall 28B, and bottom wall 24. Inside that frame holder 20 can be moveable card frame holder(s) 30 which will be described in greater detail in FIGS. 2-3. Within front U-shaped wall 28A can be a front facing sign board 42 with indicia, slidably held therein, and within rear U-shaped wall 28 B can be rear facing sign board 44 with indicia, slidably held therein. Behind front facing sign board 42 can be a front stationary card frame 50, and behind rear facing sign board 44 can be rear stationary card frame 60.

Underneath frame holder 20 can be a longitudinal handle 80 such as a pole, and the like, that allows a user to support and raise the frame holder 20 securely and in a stable condition in one hand. Additionally, or alternatively, the frame holder 20 can include a pair of right side facing lip edges 72, 74 each can have ribbed or roughened surfaces, and a pair of left side facing lip edges 76, 78, each having ribbed or roughened surfaces thereon. The lip edges 72-78 allow a user to grip the frame holder with two hands to support and raise the frame holder 20 as needed.

Figure 2:
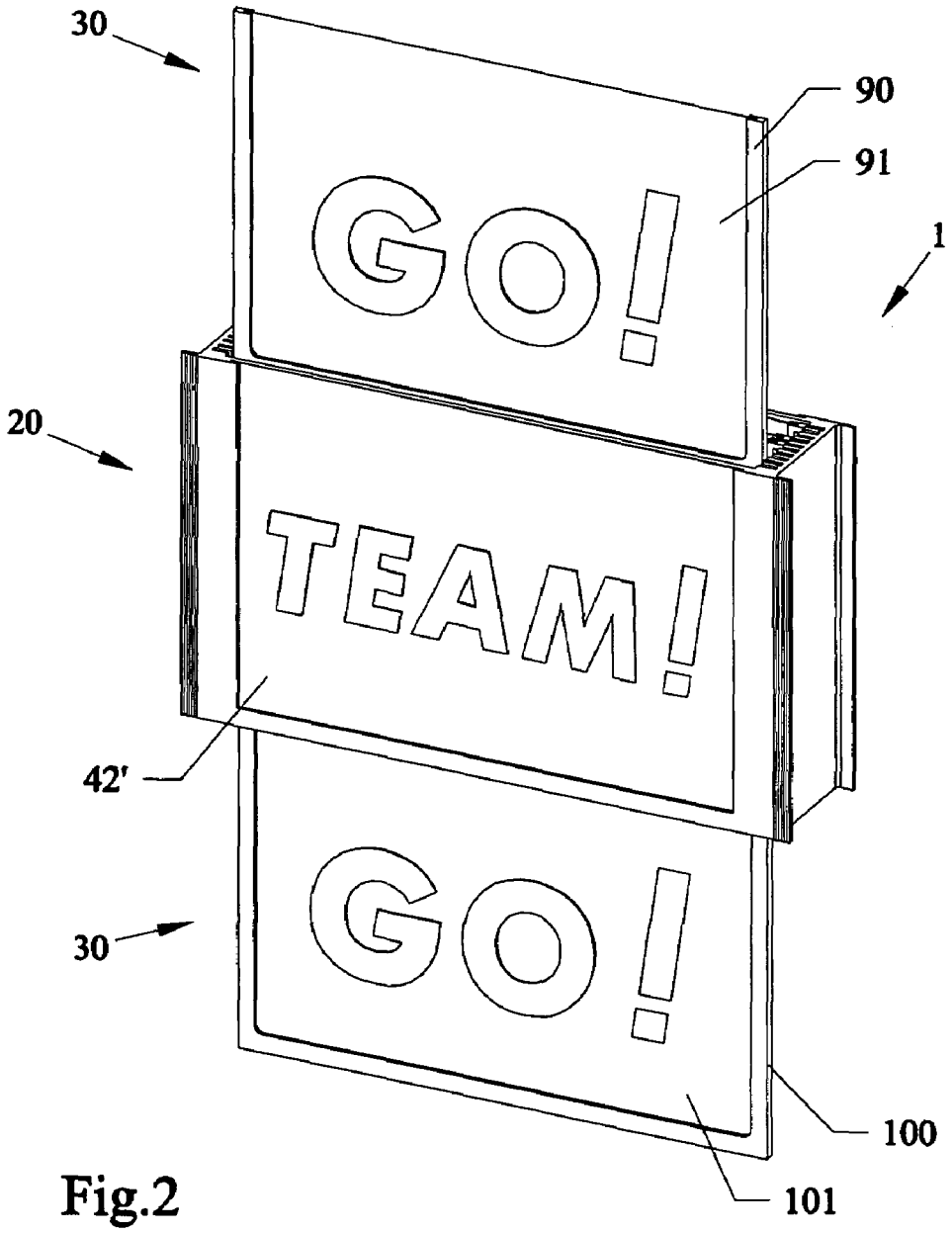
FIG. 2 shows the sign device with an upper sign and lower sign extended out.

Referring to FIG. 2, the card holder frame 20 can include plural moveable card frame holder(s) 30 such as an upper sign 90 and a lower sign 100. FIG. 2 shows the sign device 1 with an upper sign frame 90 and lower sign frame 100 extended out from the card holder frame 20. The detail showing how the moveable card frame holder(s) 30 are able to stay in an upward extended position and in a downward extended position will be described in reference to FIGS. 4-10A. The card frame holder 20 here uses three signboards 91, 42', 101 to spell out a message, which is depicted here as "GO TEAM! GO!."

Figure 3:
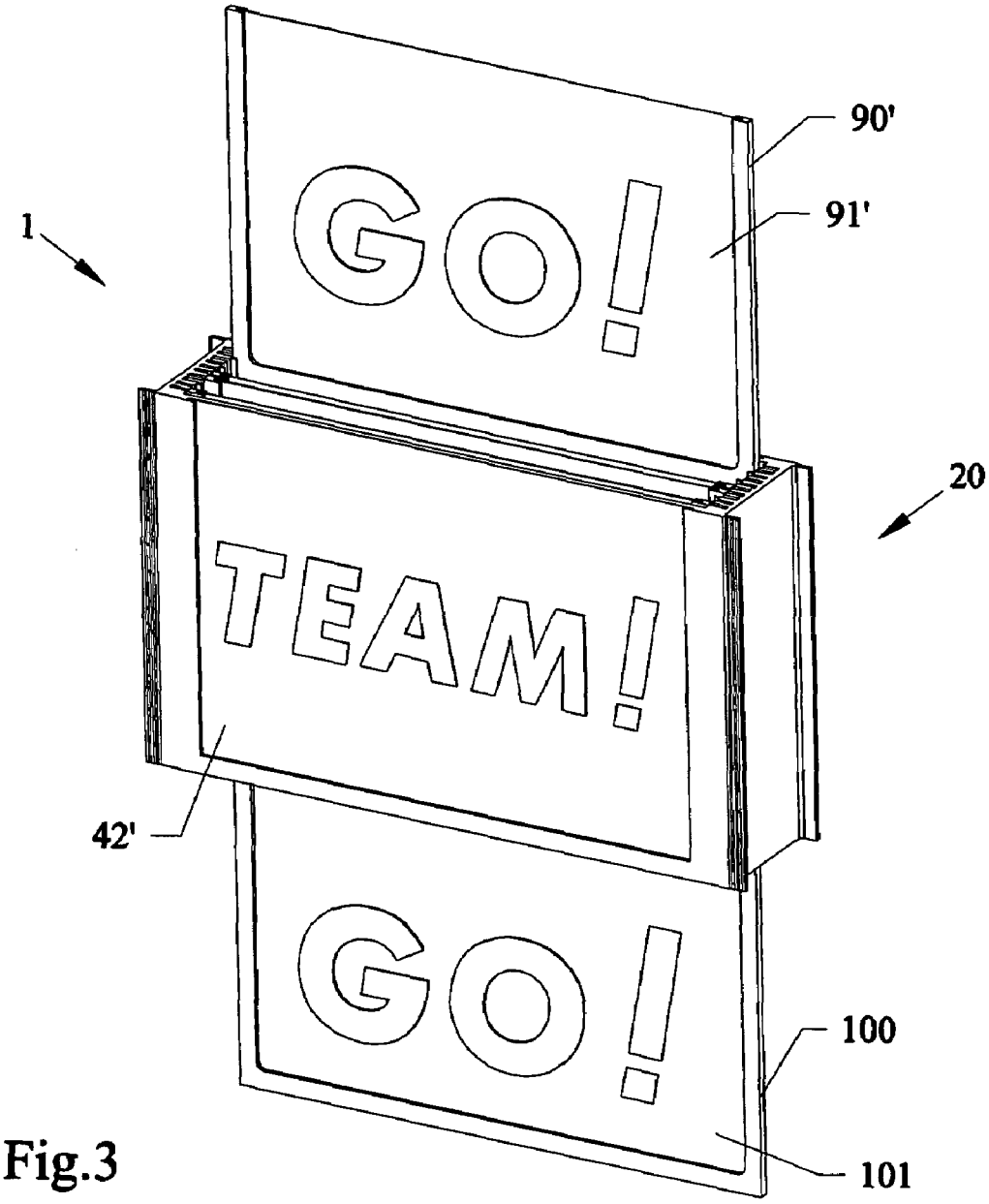
FIG. 3 shows the sign device with a different upper sign extended out along with the lower sign extended out.

FIG. 3 shows the sign device 1 with a different upper sign 90' having signboard 91' extended out along with the lower sign 100 extended out. Here, the message can be the same as that of FIG. 2, but by using a different upper sign 90' with sign board 91'.

Figure 4:
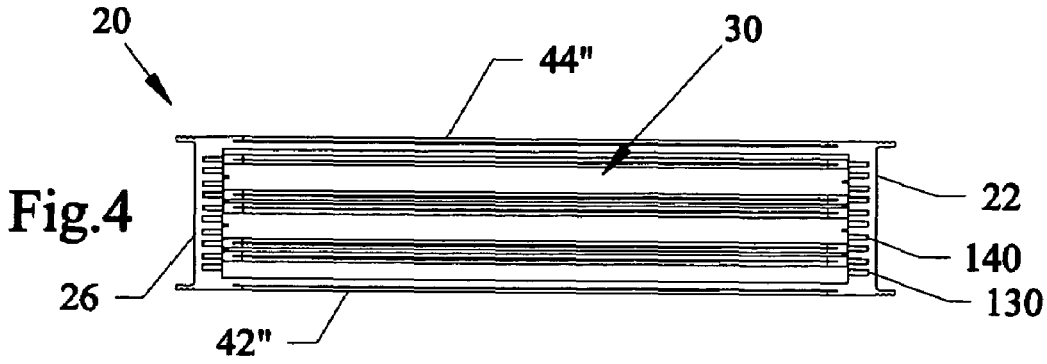
FIG. 4 is a top view of the novel sign device of the preceding figures.
Figure 5:
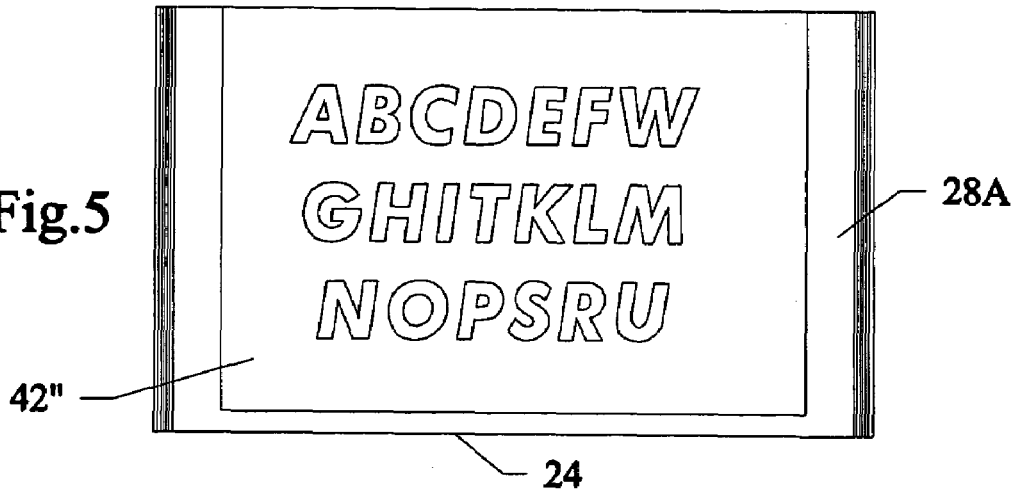
FIG. 5 is a front view of the sign device of FIG. 4.
Figure 6:
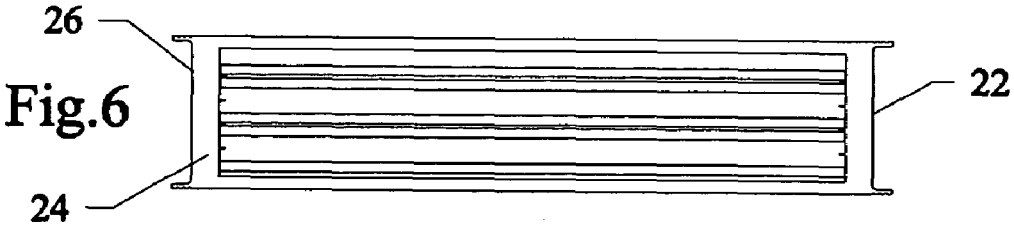
FIG. 6 is a bottom view of the sign device of FIGS. 4-5.

FIG. 4 is a top view of the novel sign device 1 of the preceding figures, where tops of inner side edge channels 130, 140 can be seen. FIG. 5 is a front view of the sign device 1 of FIG. 4 front sign board 42" and rear sign board 44". FIG. 6 is a bottom view of the sign device 1 of FIGS. 4-5.

Figure 7:
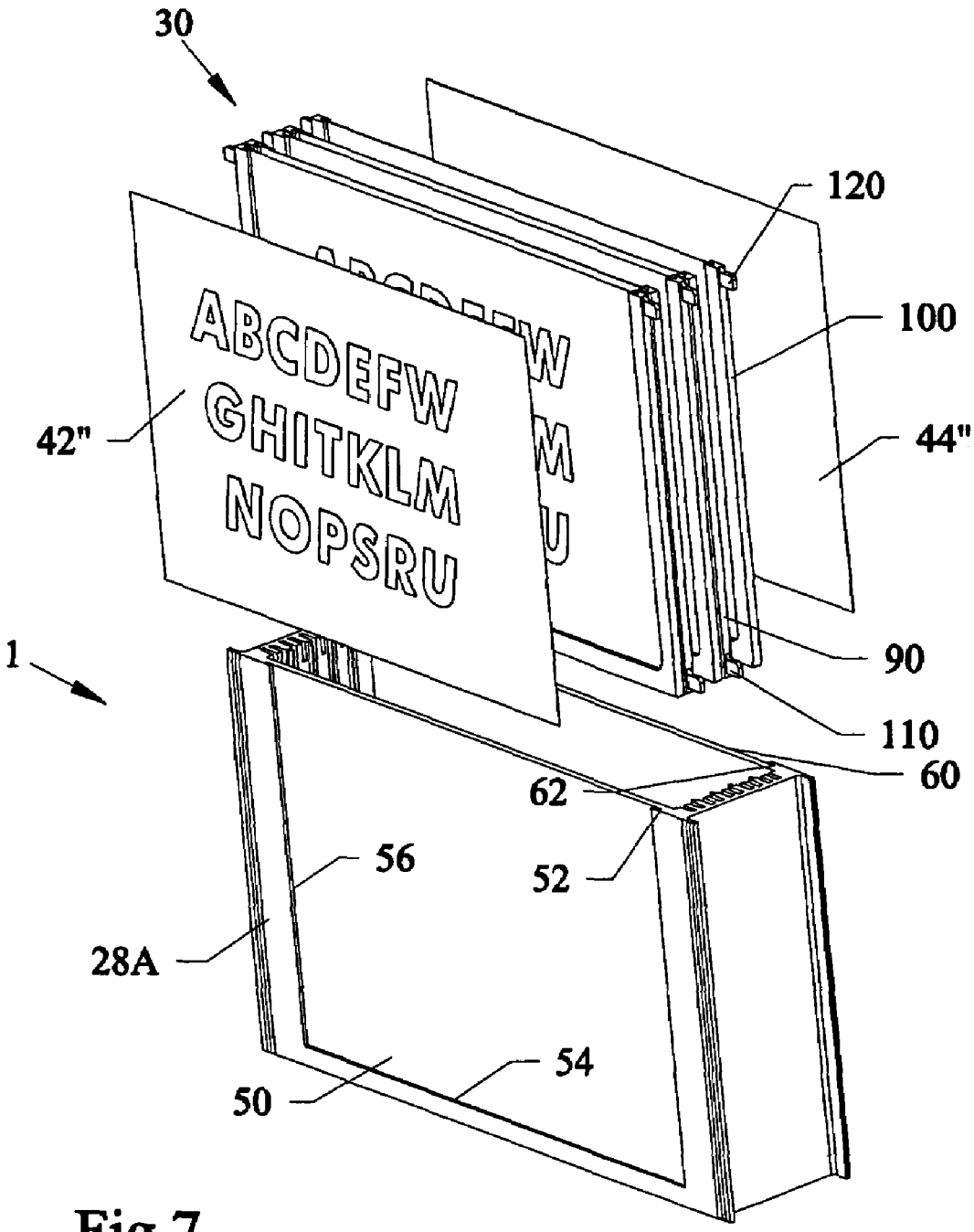

FIG. 7 shows the sign device 1 of the preceding figures with the sign boards 42", 44" and plural tip and bottom moveable card frame holders 30 separated there from. Front stationary card frame 50 can include right side, bottom side, and left side slot edges 52, 54, 56 for allowing the left, right, and bottom perimeter edges of the front sign board 42" to slide into and out of. Likewise, rear stationary card frame 60 includes similar located slot edges(of which only 62 is shown) for allowing rear sign board 44" to slide into and out of.

The top card frame 90 can include a pair of lower side tab(s) 110 for locking the top card frame 90 in an extended position. The bottom card frame 100 can include a pair of upper side tab(s) 120 for locking the bottom card frame 100 in an extended position.

Figure 8:
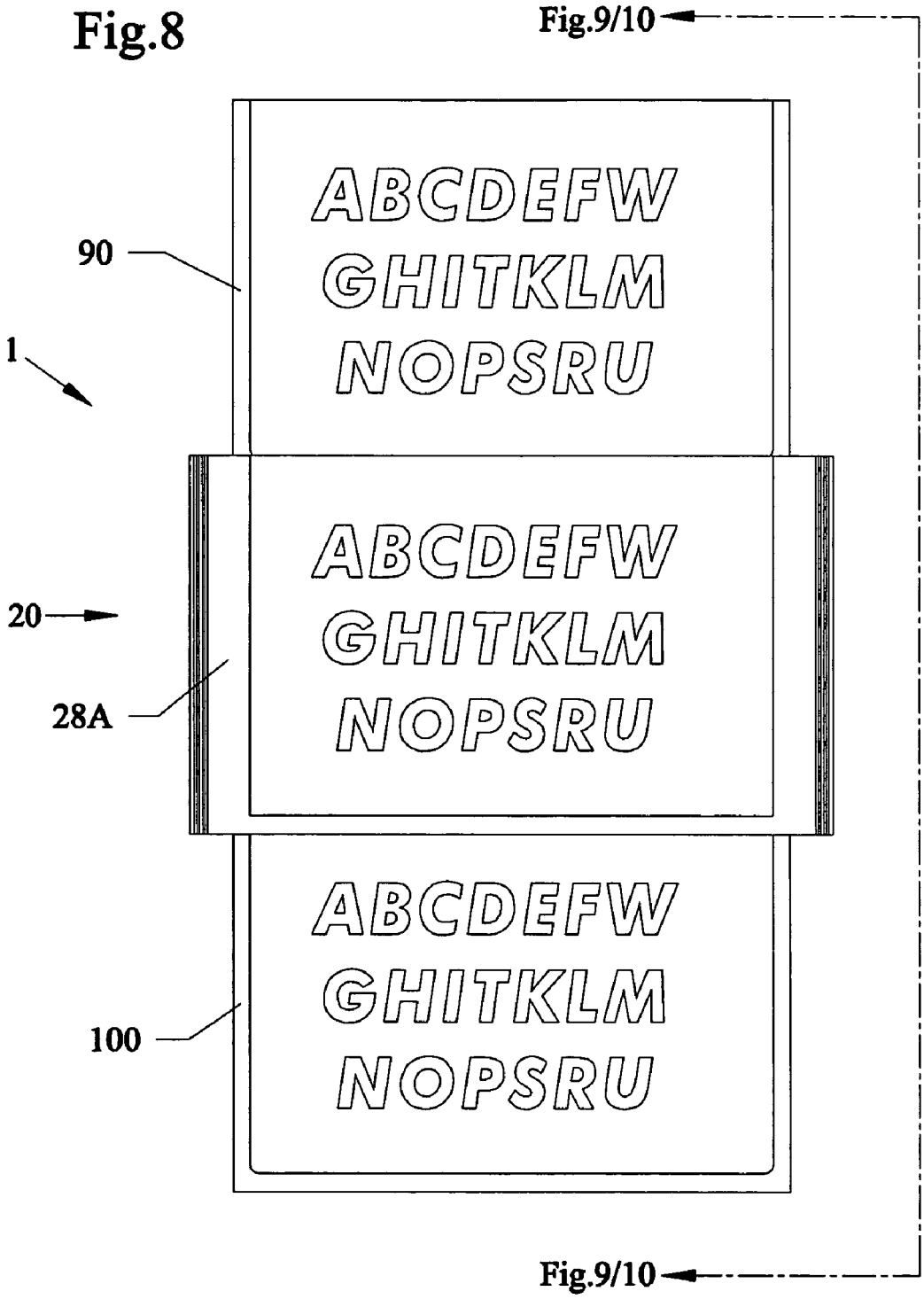
FIG. 8 shows the sign device of FIG. 7 with the top sign and bottom sign extended out.

FIG. 8 shows the sign device 1 of FIG. 7 with the top card frame 90 and bottom card frame 100 extending out from frame holder 20.

Figure 9:
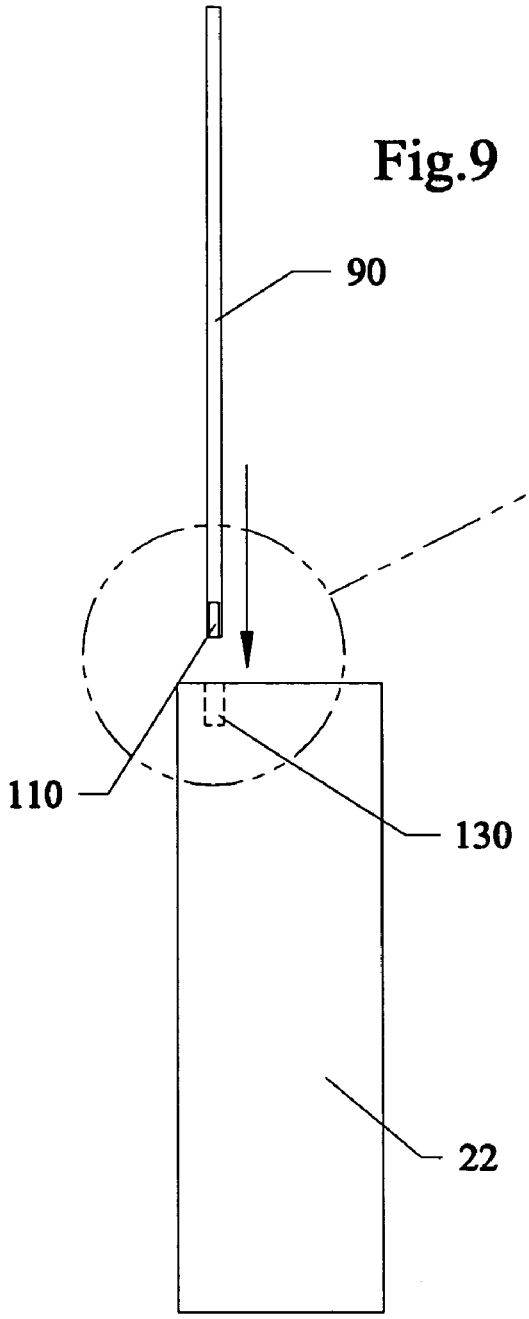
Figure 9A:
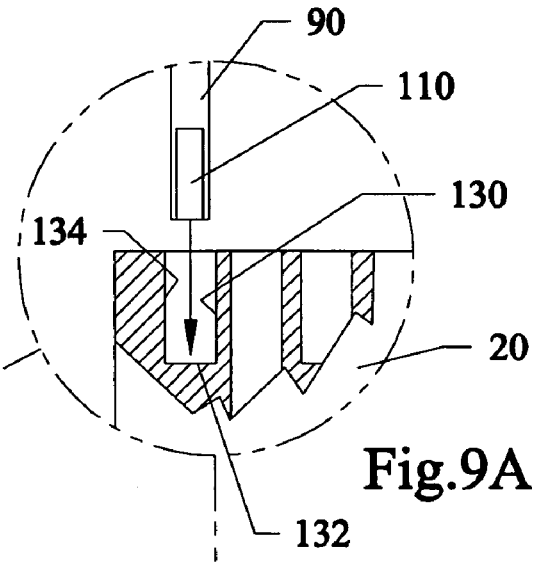
FIG. 9A is an enlarged interior view of the separated top sign and sign device of FIG. 9.

FIG. 9 is a side view of the sign device 1 of FIG. 8 with the top card frame 90 separated there from. Along inside of right side wall 22, and left side wall 26 of frame holder 20 can be narrow depth channel 130 having floor portion(s) 132. FIG. 9A is an enlarged view of the separated top card frame 90 and top of the sign device 1 of FIG. 9. The top card frame 90 has been slid out of the inner side edge channels 140 within frame holder 20, and is ready to be positioned into a inner side edge channel 130.

Figure 9B:
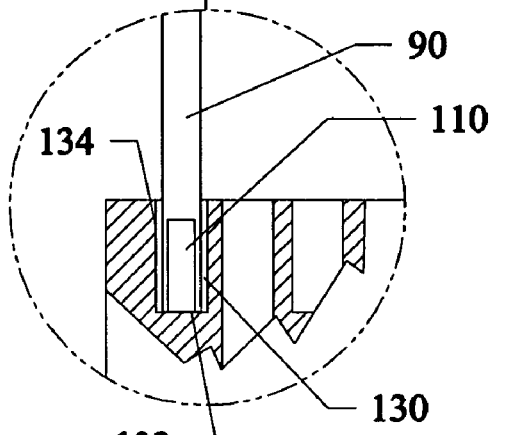
FIG. 9B shows another interior view of FIG. 9A with the top sign being inserted into a catch slot on the sign device.

FIG. 9B shows another view of FIG. 9A with the top card frame 90 being inserted into the narrow depth channel 130 where the sides 134 and bottom 132 of the channel 130 together from a catch slot for holding and supporting the lower side extending tabs 110 of the top card frame 90 so that the top card frame 90 is in an extended position above frame holder 20.

Figure 10:
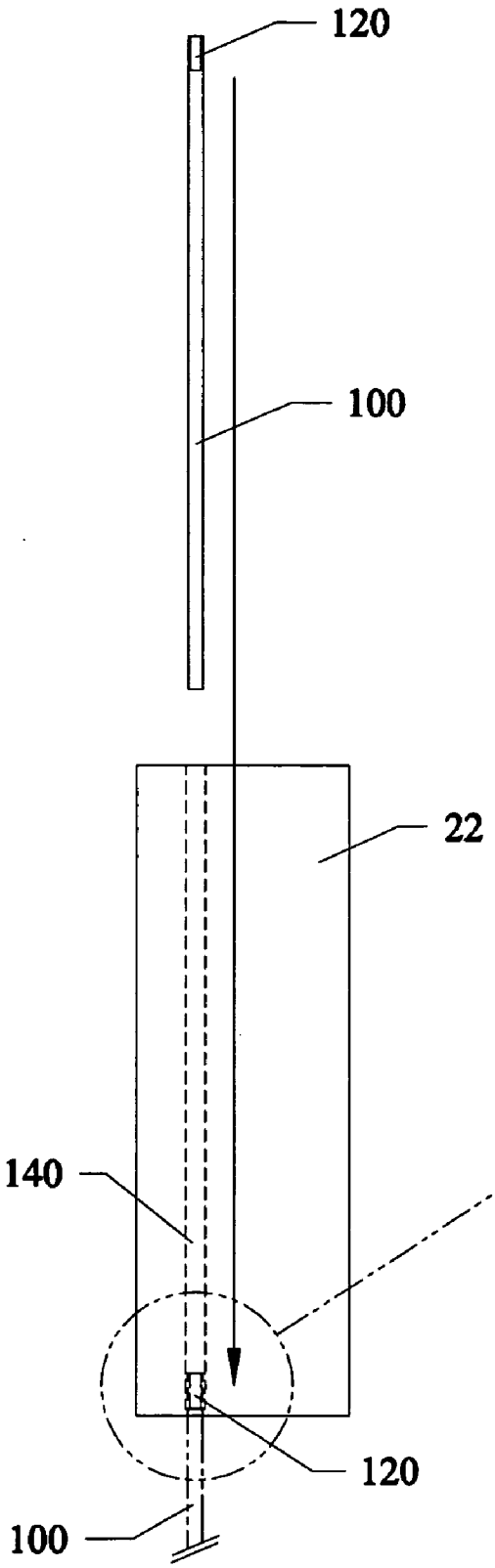
FIG. 10 shows another side view of the sign device of FIG. 8 with a bottom sign separated from the sign device.

FIG. 10 shows another side view of the sign device 1 of FIG. 8 with a bottom sign card separated from the sign device 1. Initially, the bottom sign card can be stored within a section of the frame holder 20 having one of the narrow depth channels 130. In FIG. 10, the bottom card frame 100 has been slid out of the frame holder 20 and is ready to be positioned into a longitudinal depth channel 140.

Figure 10A:
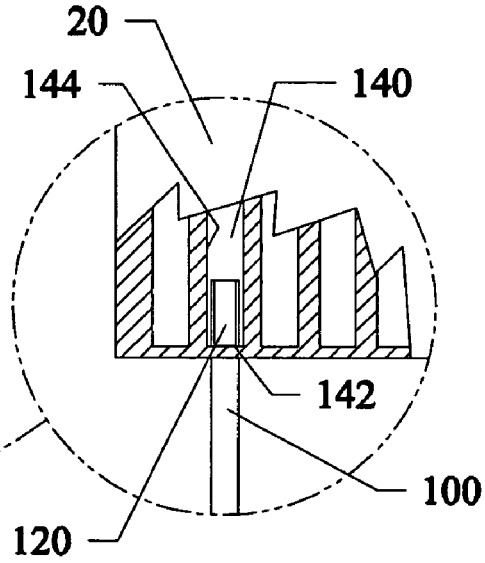
FIG. 10A is an enlarged interior view of the bottom sign of FIG. 8 held in place by the catch slot.

FIG. 10A is an enlarged view of the bottom card frame 100 of FIG. 8 held in place by the upper side extending tabs 120 that are held in place by the sides 144 and bottom 142 of the longitudinal channel 140 which form another catch slot for holding and supporting the bottom card frame 100 in an extended position below the frame holder 20

Figure 12:
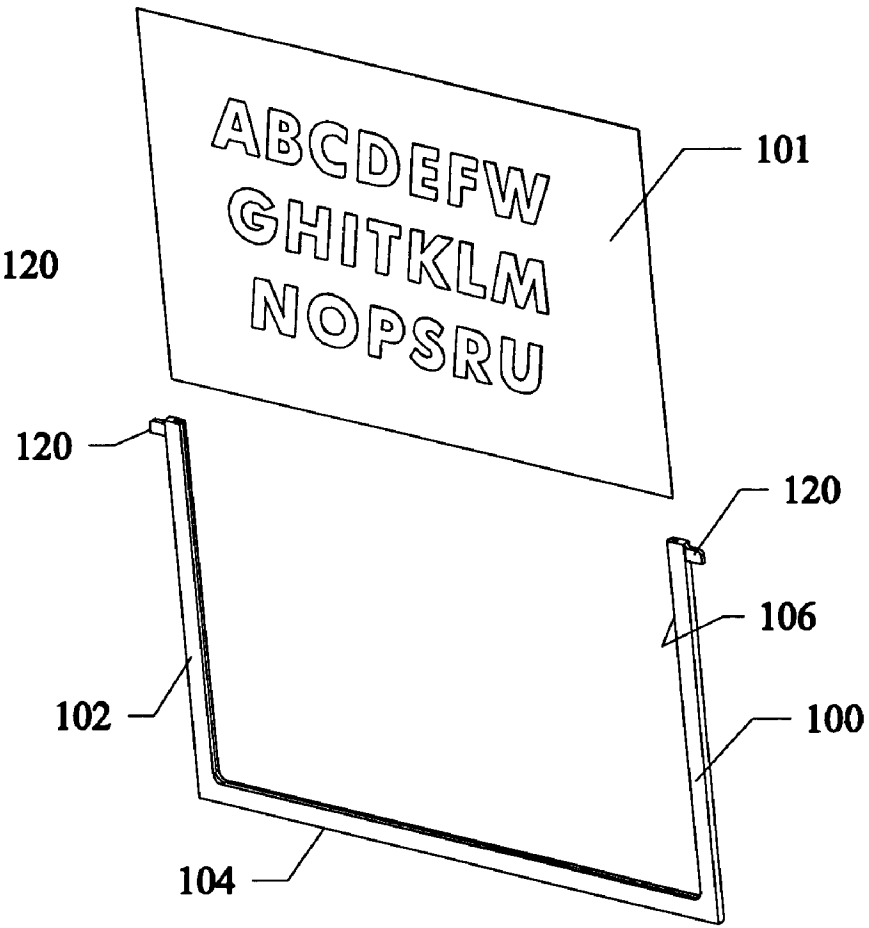
FIG. 12 is an exploded view of the bottom sign of FIG. 11 separated from the signboard.
Figure 11:
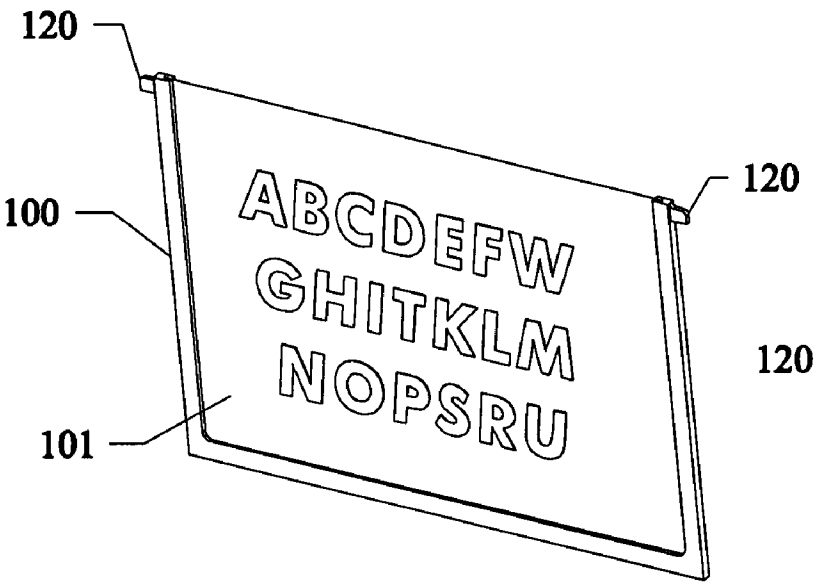
FIG. 11 is a perspective view of the bottom sign of the preceding figures.
Figure 14:
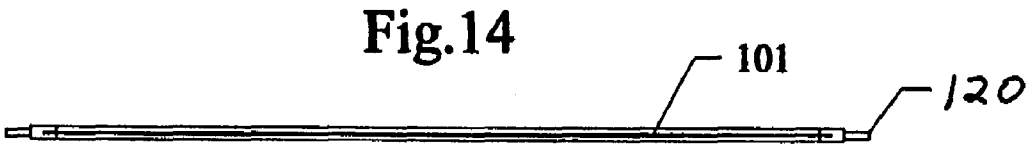
FIG. 14 is a top view of the bottom sign and signboard of the preceding figures.
Figure 13:
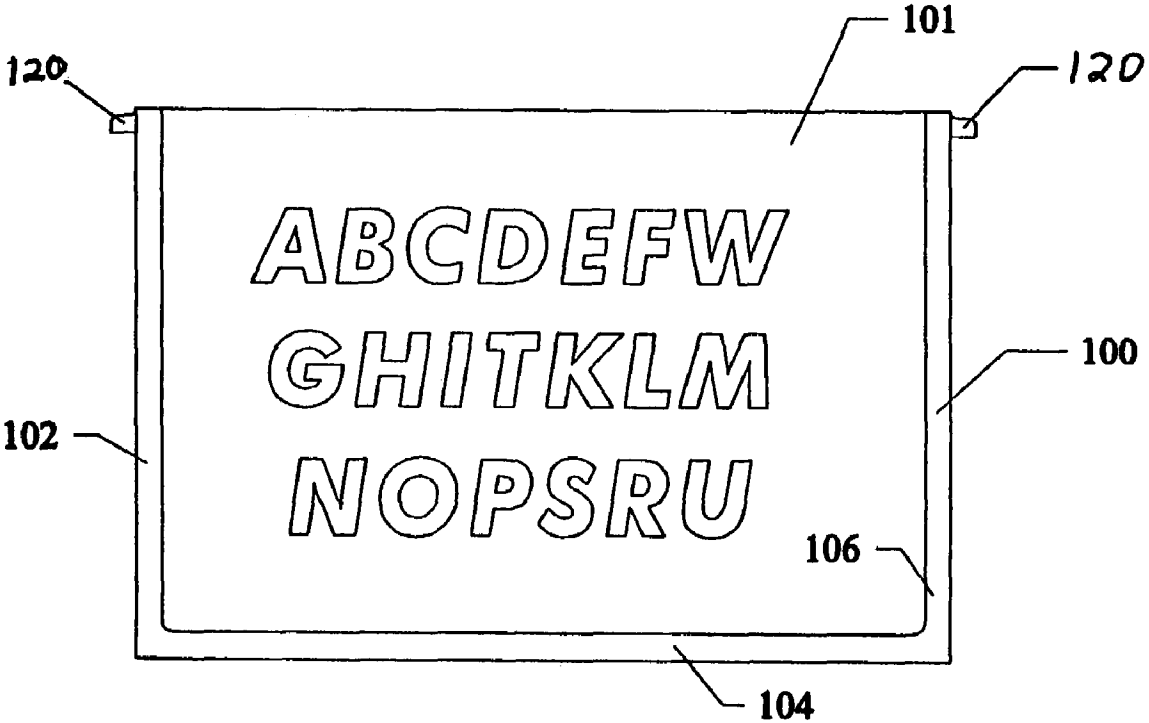
FIG. 13 is a front view of the bottom sign of the preceding figures.
Figure 15:
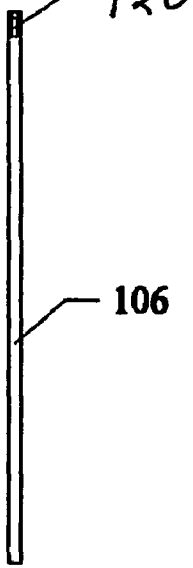
FIG. 15 is a right side view of the bottom sign of the preceding figures.

FIG. 11 is a perspective view of the bottom card frame 100 of the preceding figures with a signboard 101 inserted inside. FIG. 12 is an exploded view of the bottom card frame 100 of FIG. 11 separated from the signboard 101. FIG. 13 is a front view of the bottom card frame 100 with signboard 101 of the preceding figures. FIG. 14 is a top view of the bottom card frame 100 and signboard 101 of the preceding figures. FIG. 15 is a right side view of the bottom card frame 100 of the preceding figures.

Referring to FIGS. 11-15, the bottom card frame 100 can include a U-shaped frame having left leg 102, bottom leg 104 and right leg 106, each with interior facing longitudinal slots in the respective legs that allow a signboard 101 having indicia thereon to be slid into the bottom card frame 100.

Figure 17:
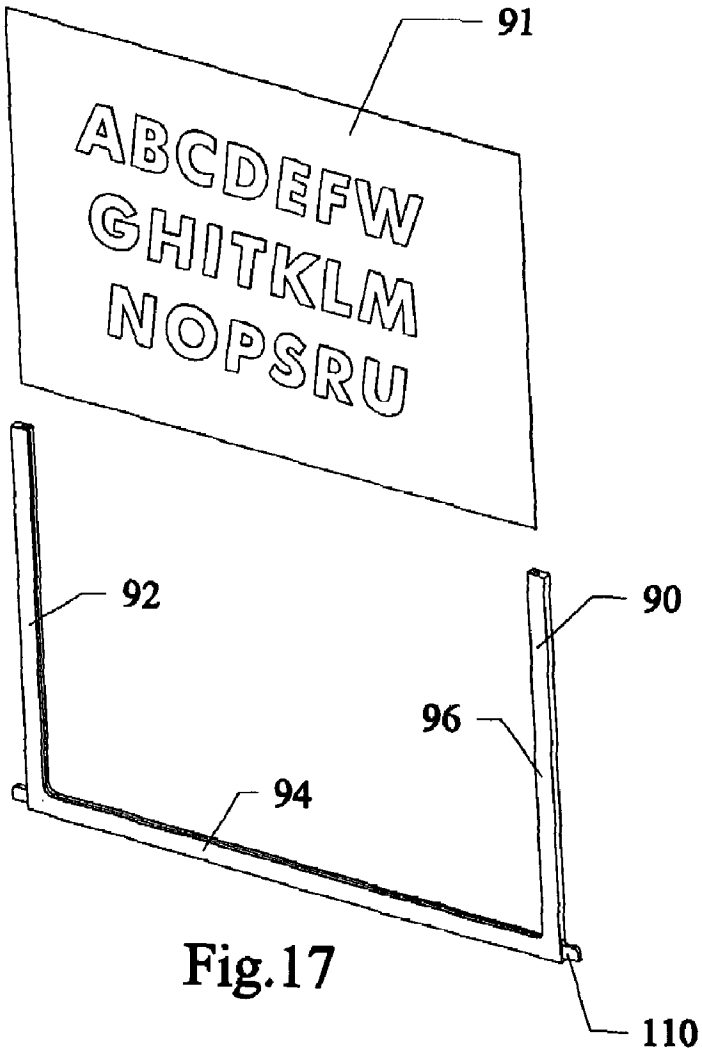
FIG. 17 is an exploded view of the top sign of FIG. 16 separated from the signboard.
Figure 16:
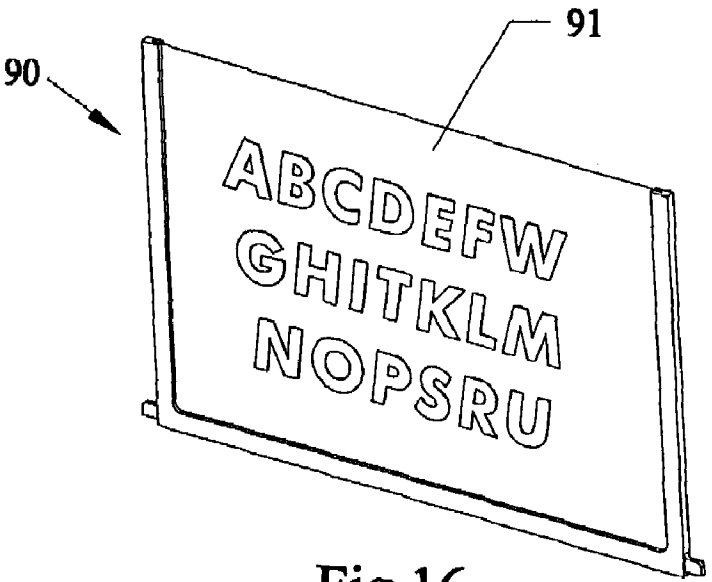
FIG. 16 is a perspective view of the top sign of the preceding figures.
Figure 19:
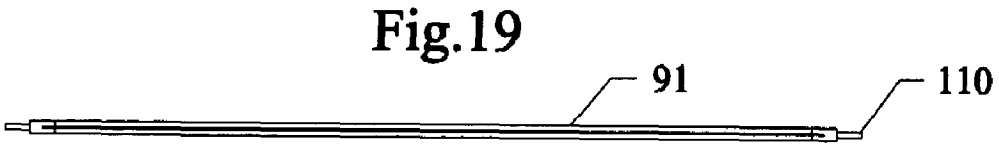
FIG. 19 is a top view of the top sign and signboard of the preceding figures.
Figure 18:
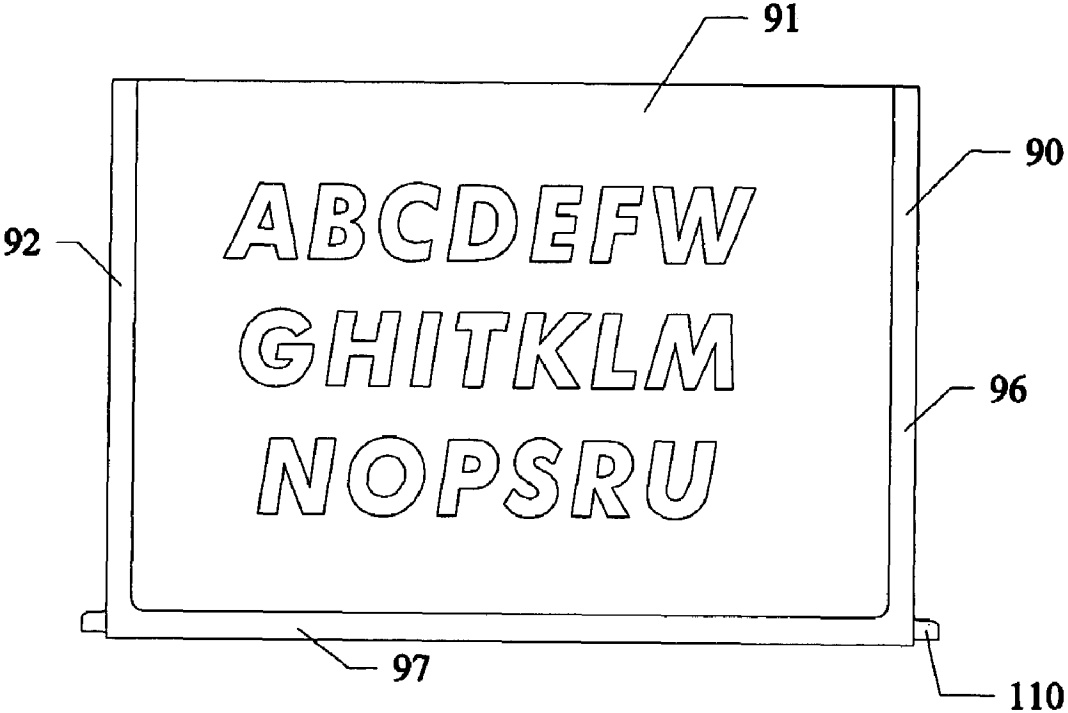
FIG. 18 is a front view of the top sign of the preceding figures.
Figure 20:
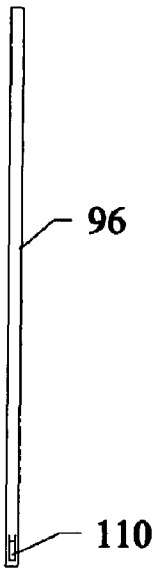
FIG. 20 is a right side view of the top sign of the preceding figures.

FIG. 16 is a perspective view of the top card frame 90 of the preceding figures. FIG. 17 is an exploded view of the top card frame 90 of FIG. 16 separated from the signboard 91. FIG. 18 is a front view of the top card frame 90 with signboard 91 of the preceding figures. FIG. 19 is a top view of the top card frame 90 and signboard 91 of the preceding figures. FIG. 20 is a right side view of the top card frame 90 of the preceding figures.

Referring to FIGS. 16-20, the top card frame 90 can include a U-shaped frame having a left leg 92, bottom leg 94 and right leg 96, each with interior facing slots in the respective legs that allows a signboard 91 having indicia thereon to be slid into the top card frame 90.

Figure 21:
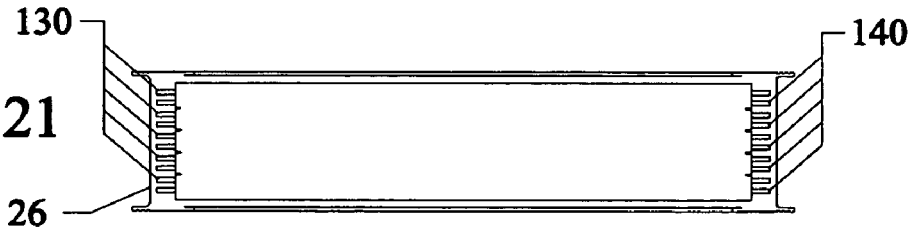
FIG. 21 is another top view of the sign device 1 of the preceding figures without any sign card frames or sign boards.
Figure 22:
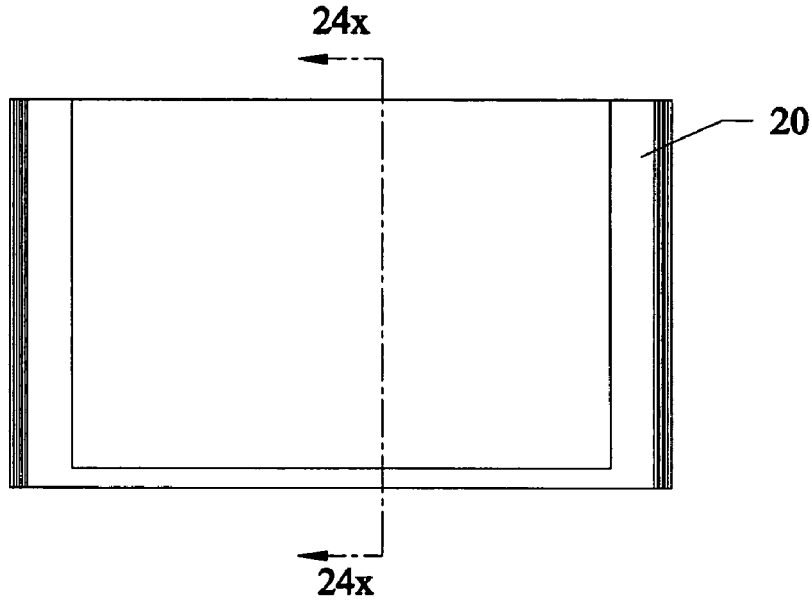
FIG. 22 is a front view of the sign device of FIG. 21.
Figure 23:
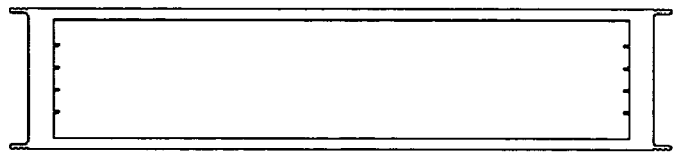
FIG. 23 is a bottom view of the sign device of FIG. 22.
Figure 24:
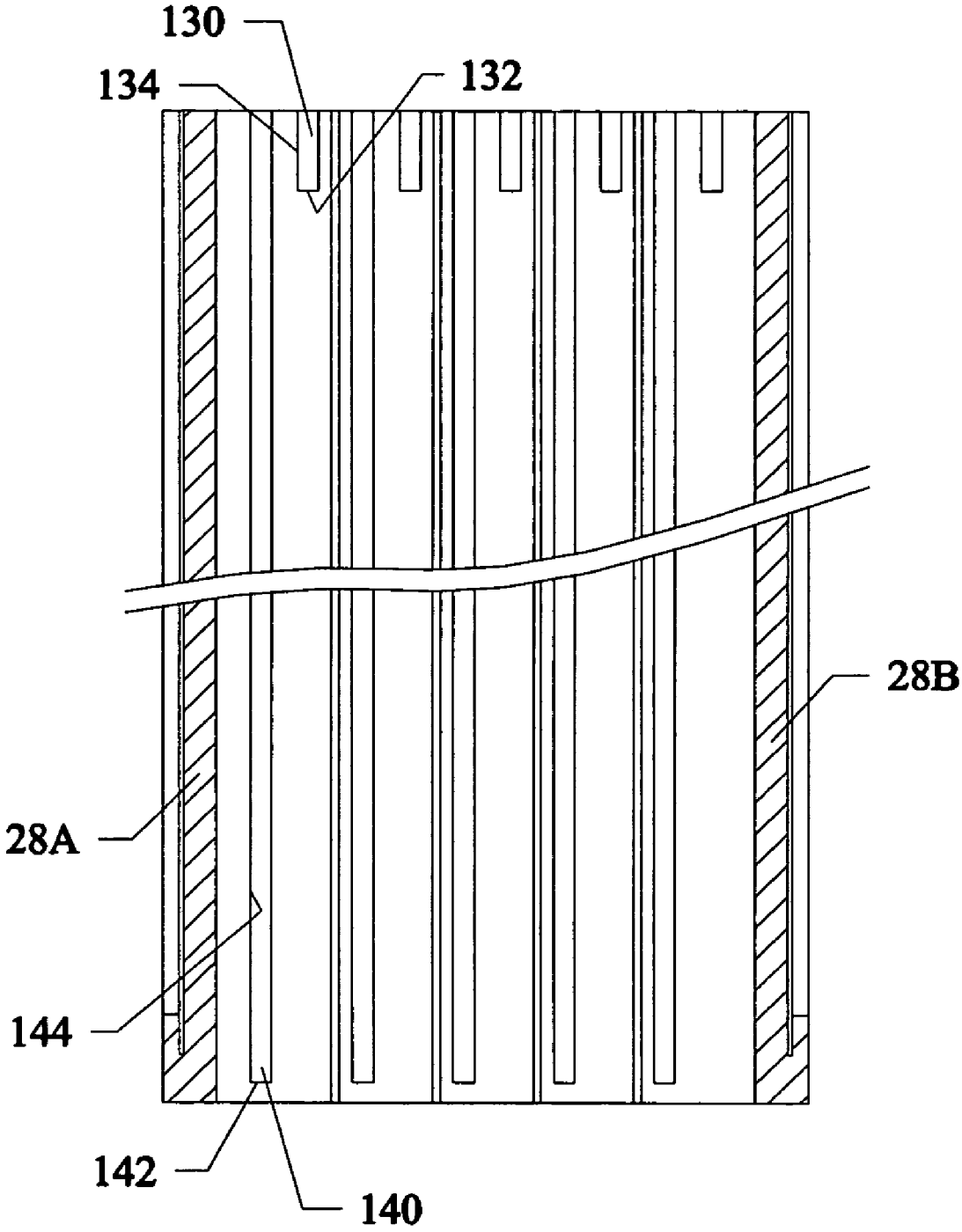
FIG. 24 is a cross-sectional view of FIG. 22 along arrows 24X.

FIG. 21 is another top view of the sign device 1 of the preceding figures without any sign card frames or sign boards stored inside. FIG. 22 is a front view of the sign device 1 of FIG. 21. FIG. 23 is a bottom view of the sign device 1 of FIG. 22. FIG. 24 is a cross-sectional view of FIG. 22 along arrows 24X which shows inside details of the sides 144 and bottom 142 of longitudinal channels 140, and sides 134 and bottom 132 of narrow depth channels 130, that are used with the preceding figures.

Figure 25:
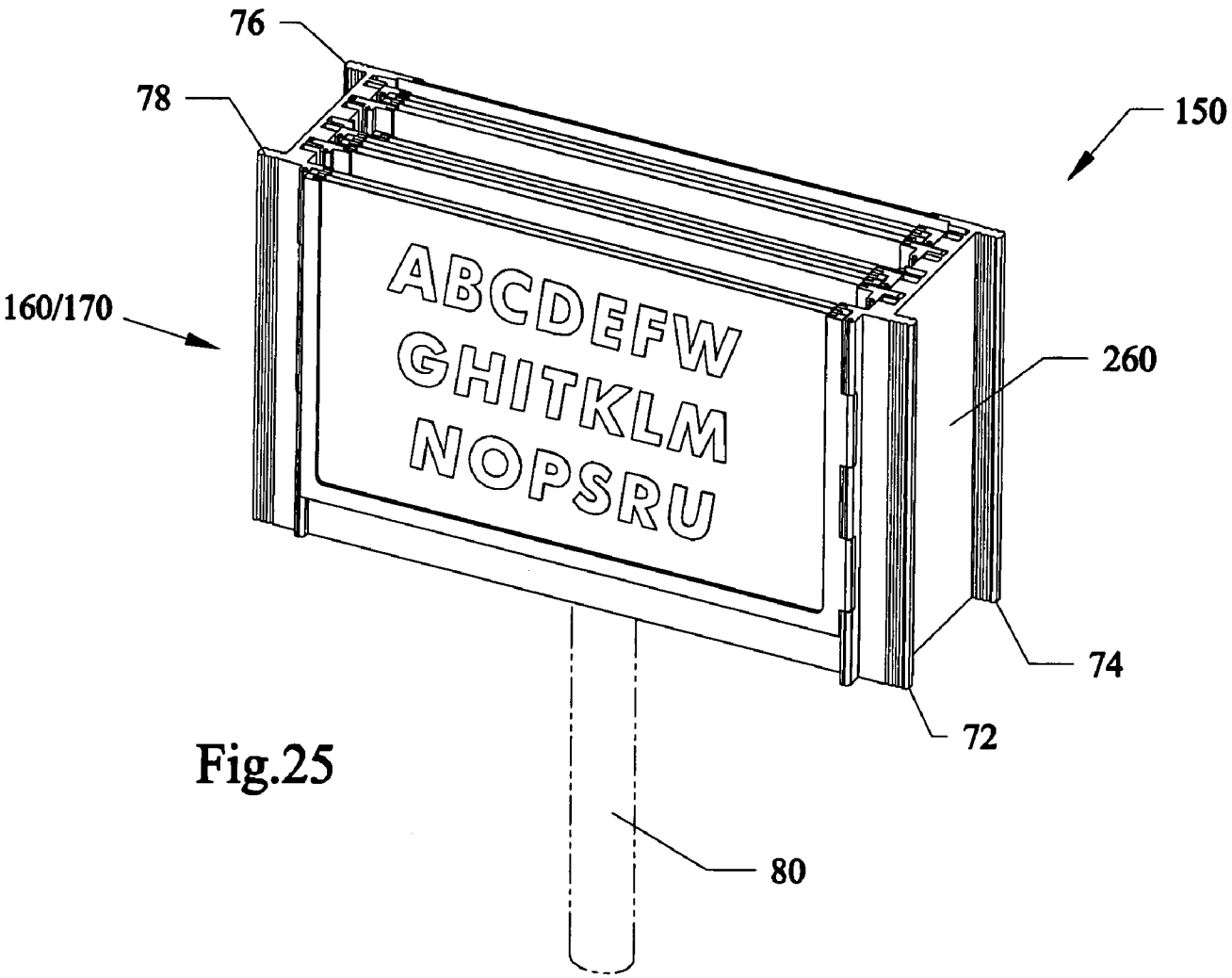
FIG. 25 is a perspective front view of a hinged signboard embodiment of the sign device.
Figure 26:
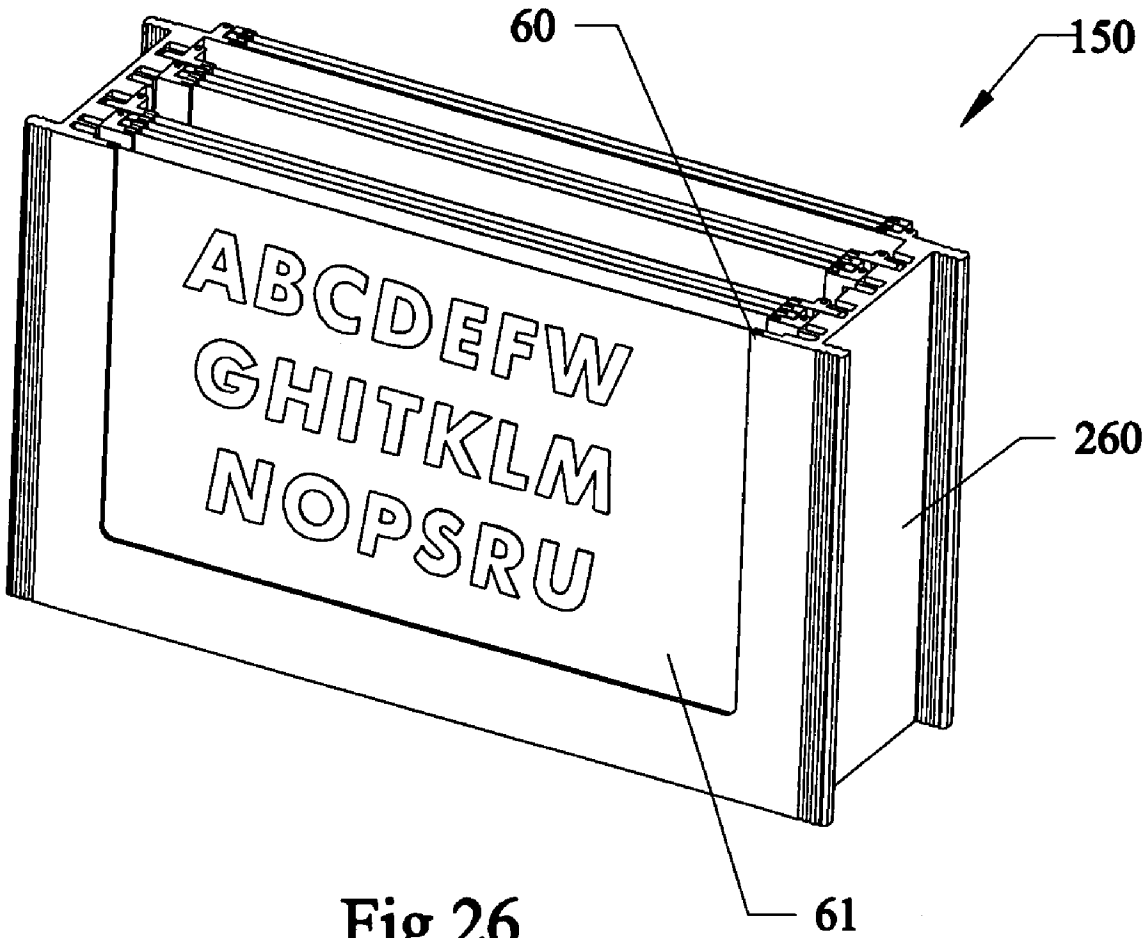
FIG. 26 is a perspective rear view of the sign device of FIG. 25.

FIG. 25 is a perspective front view of a hinged signboard embodiment 150 of the sign device 1 of the preceding figures. FIG. 26 is a perspective rear view of the hinged sign device 150 of FIG. 25. Referring to FIGS. 25-26, hinged sign device 150 includes a frame holder 260 having a front hinged sings 160/170 which will be explained in detail in the next figures, and a rear stationary card frame 60 that supports a signboard 61 slidably therein.

Frame holder 260 can include a longitudinal pole holder 80 extending underneath for allowing the frame holder 260 to be supported and raised by a single hand of a user. Frame holder 260 can additionally, or alternatively include a pair of right side facing lip edges 72, 74 each can have ribbed or roughened surfaces, and a pair of left side facing lip edges 76, 78, each having ribbed or roughened surfaces thereon. The lip edges 72-78 allow a user to grip the frame holder with two hands to support and raise the frame holder 260 as needed.

Figure 27:
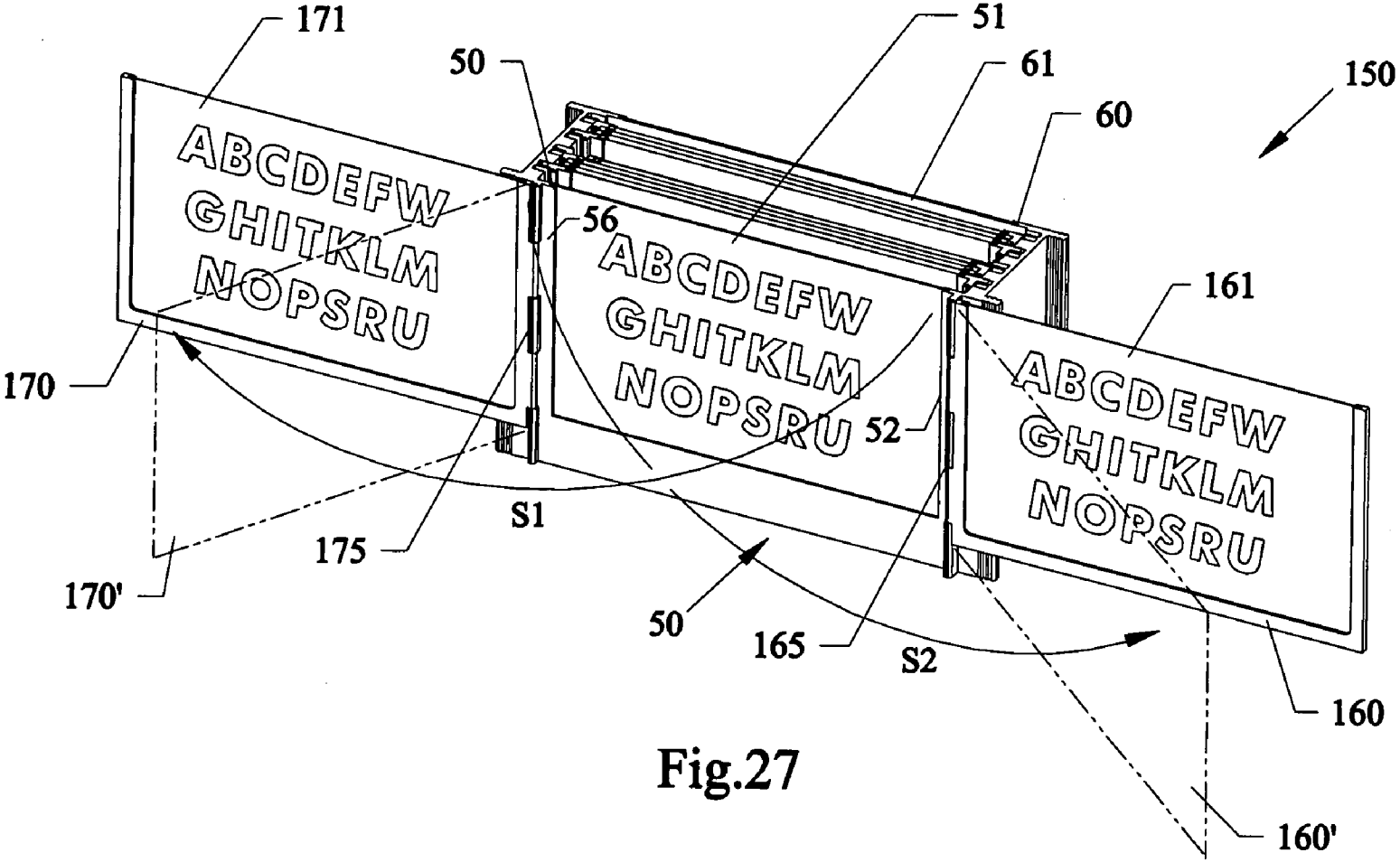
FIG. 27 shows the embodiment of FIGS. 25-26 with front signs swung outward.

FIG. 27 shows the embodiment 150 of FIGS 25-26 with front signs 160, 170 swung outward. Attached to the left side wall 56 of front stationary card frame 50 can be hinges 75 that connect to a left swinging card frame 170. Card frame 170 can be U-shaped such as the previously described card frames, and include a sign board 171 with indicia thereon, that can be slidably stored on the frame 170. Card frame 170 can move from a closed position directly overlaying front stationary card frame 50 to swing outward in the direction of arrow S1 as shown by 170'. Attached to the right side wall 52 of front stationary card frame 50 can be hinges 165 that connect to a right swinging card frame 160. Card frame 160 can be U-shaped such as the previously described card frames, and include a sign board 161 with indicia thereon, that can be slidably stored on the frame 160. Card frame 160 can move from a closed position directly overlaying front stationary card frame 50 with card frame 170 sandwiched therebetween, to swing outward in the direction of arrow S2 as shown by 160'. Here, three signboards 171, 51, and 161 can be shown with their indicia exposed outward in a side-by-side arrangement.

Figure 28:
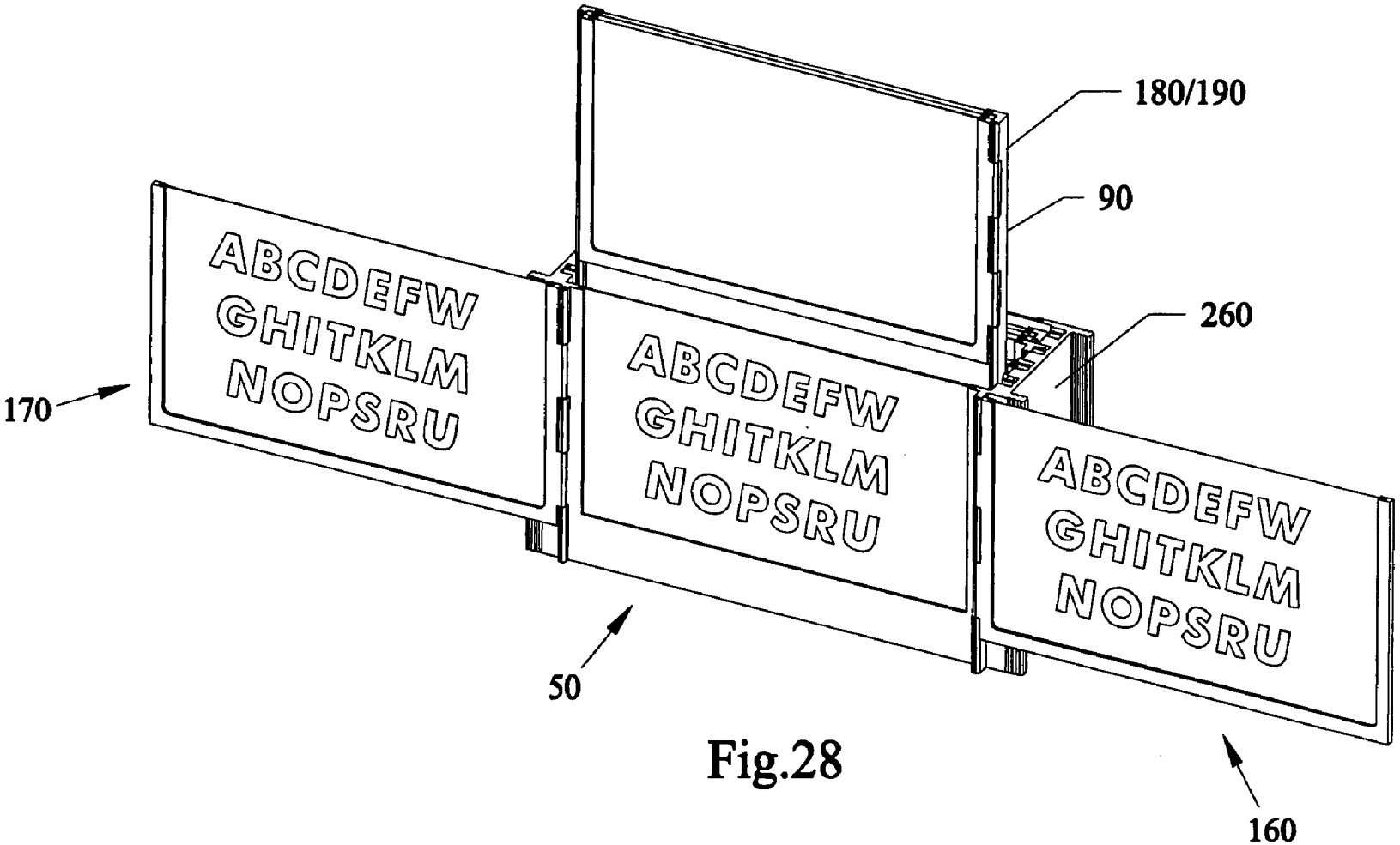
FIG. 28 shows a moveable hinged card frame holder in an extended position.
Figure 29:
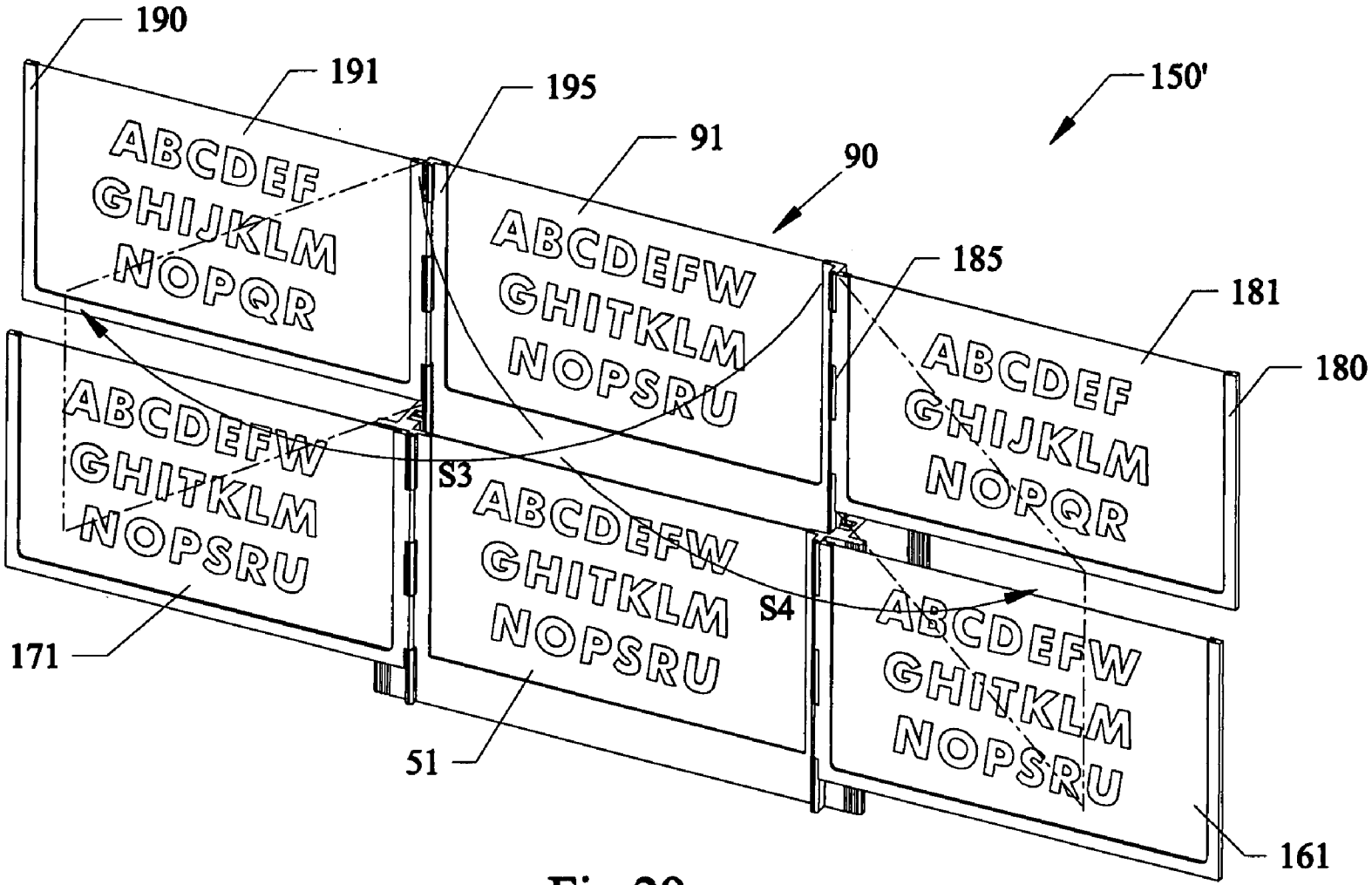
FIG. 29 shows the movable hinged card frame holder with signs swung outward.

FIG. 28 shows a moveable hinged card frame holder 180/190 in an extended position above frame holder 260. FIG. 29 sows the movable hinged card frame holder 180/190 with signs swung outward. Here, card frames 190, 180 can be hingedly attached to top frame card holder 90 by side hinges 195, 185, and can be folded against one another similar to card frame holders 50, 160, 170, previously described. Card frame 190 can be swung outward in the direction of arrow S3, and card frame 180 can be swung outward in the direction of arrow S4 so that indicia on sign boards 191, 91, and 181 are exposed. In FIG. 29, the indicia on six different sign boards can be exposed.

Figure 30:
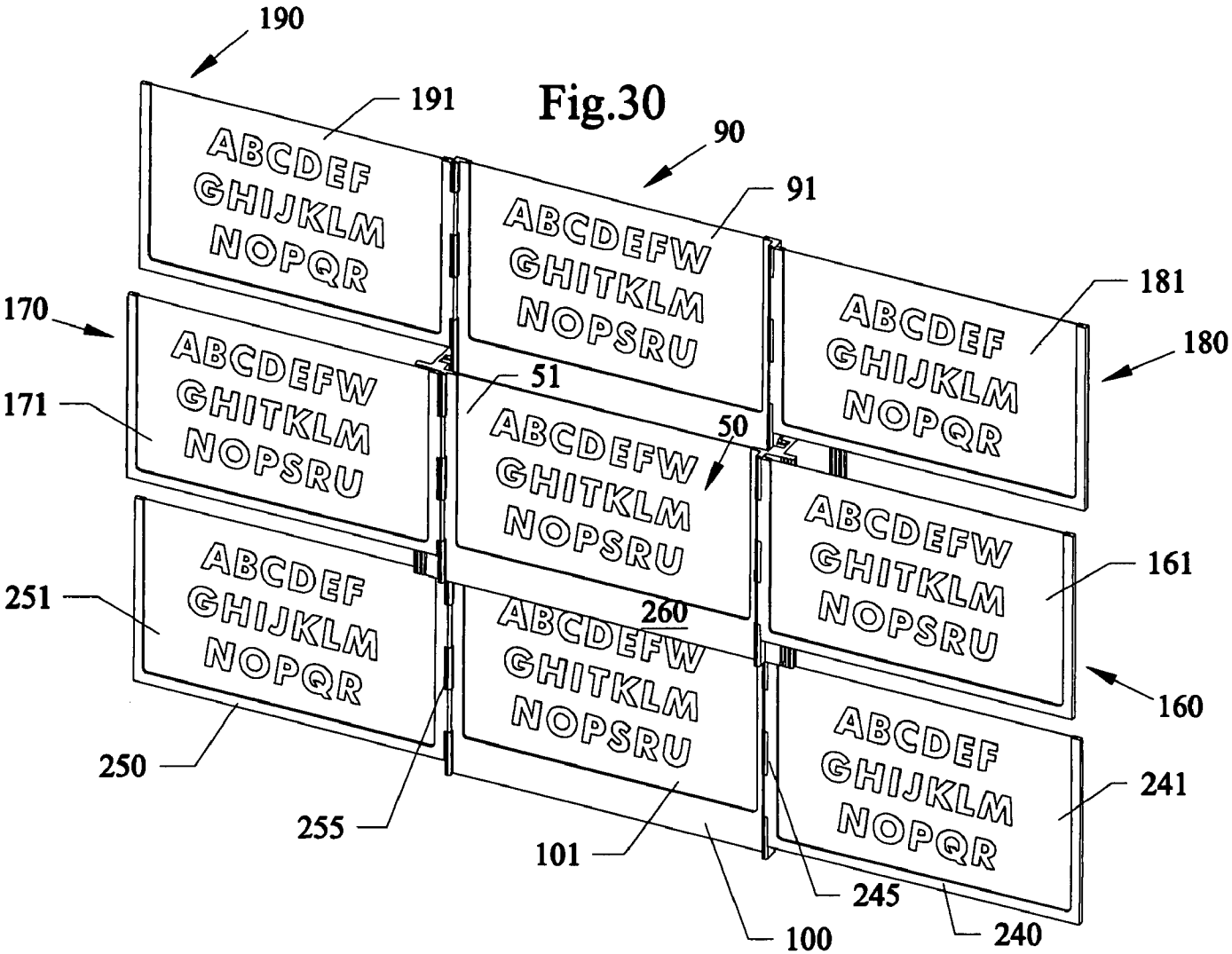
FIG. 30 shows the signs of all movable hinged card frame holders swung open.
Figure 31:
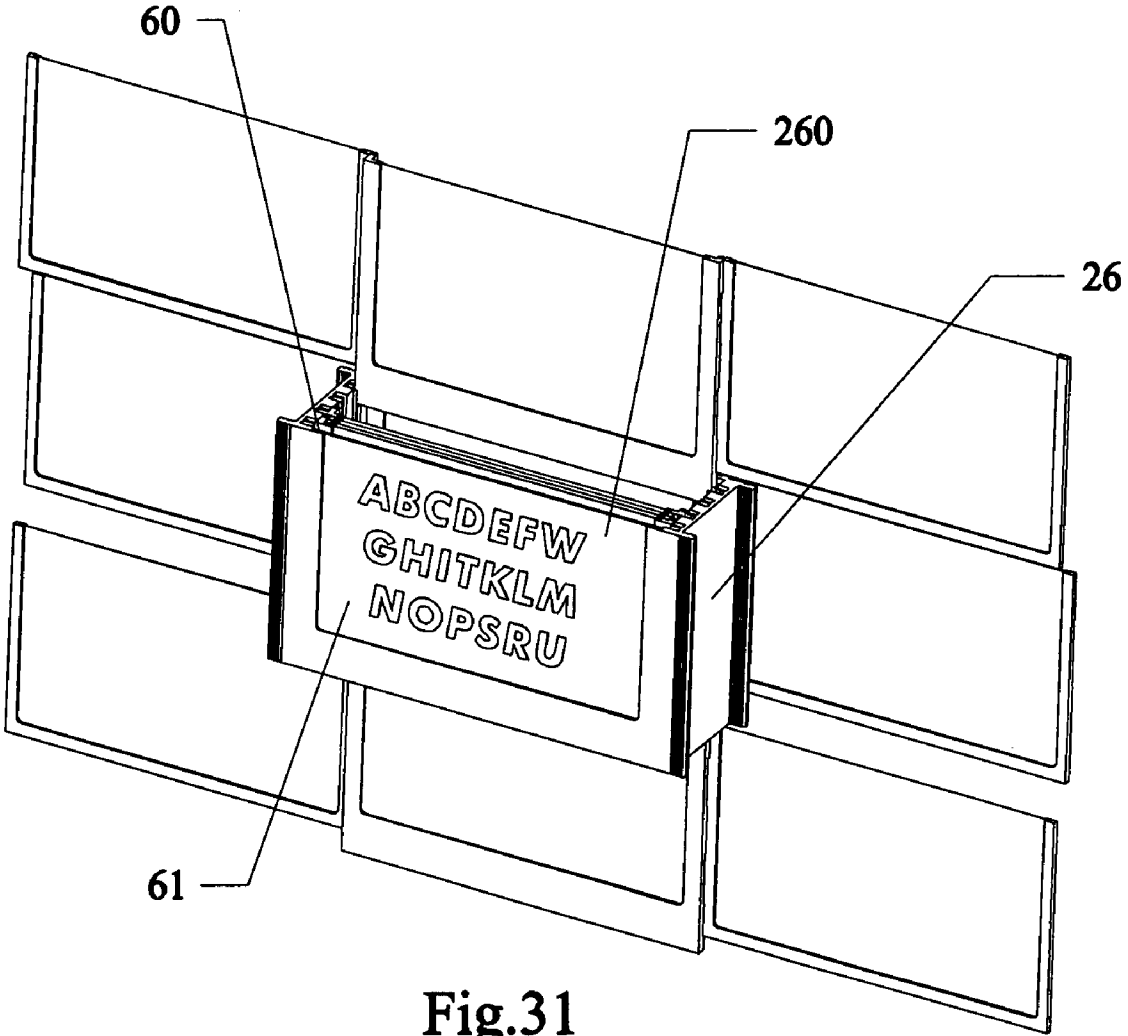
FIG. 31 is a rear view of the FIG. 30.

FIG. 30 shows the signs of all movable hinged card frame holders 190, 180, 170, 160, 240, 250 swung open. Here, the bottom card frame holder 100 which can extend downward from frame holder 260, can include card frames 250, 240 connected to card frame 100 by respective hinges 255, 245. Card frames 250, 240 can also be U-shaped frames with indicia cover sign boards 251, 241 slidably stored therein. Here, indicia on nine sign boards can be exposed. FIG. 31 is a rear view of the FIG. 30 showing at least indicia on sign board 61 of stationary card frame 60 exposed outward. The invention can also allow for indicia to be on the rear sides of the other sign boards so that indicia on up to nine sign boards can also be visible in the rear view.

Figure 32:
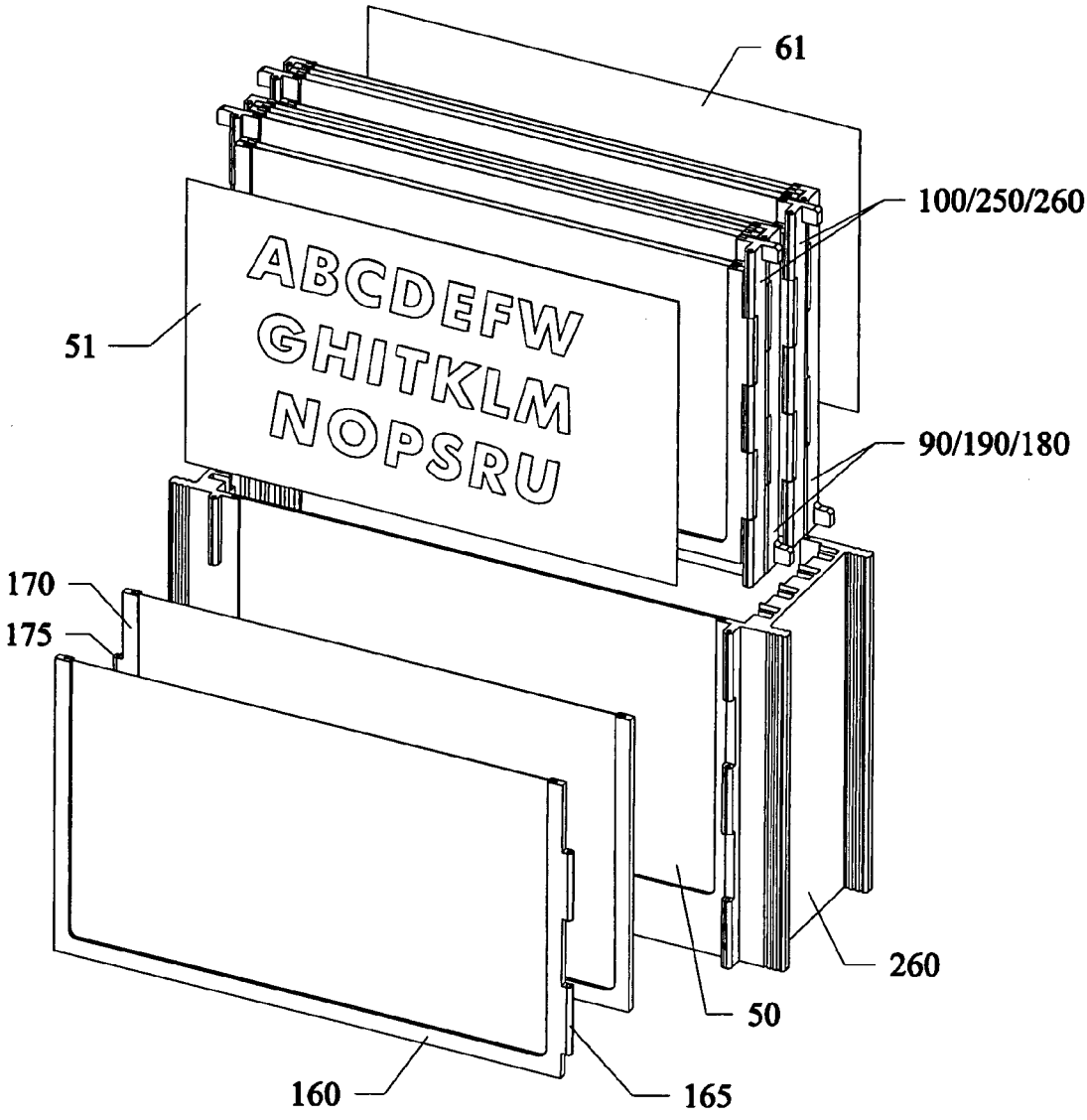
FIG. 32 is an exploded view of the hinged card frame holders separated from the card frame holder of the preceding figures.

FIG. 32 is an exploded view of the hinged card frames 100/250/260, 90/190/180, and 50/170/160 separated from the card frame holder 260 of the preceding figures.

Figure 33:
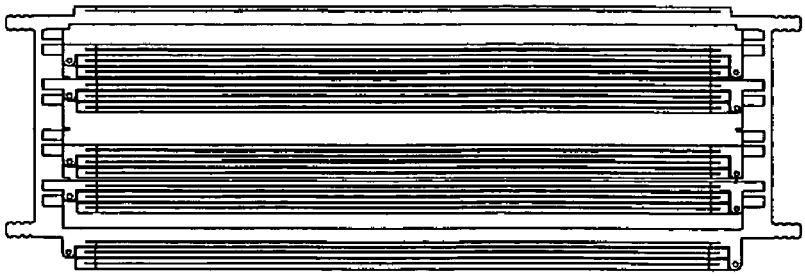
FIG. 33 is a top view of the card frame holder 260 with hinged card frames stored therein.
Figure 34:
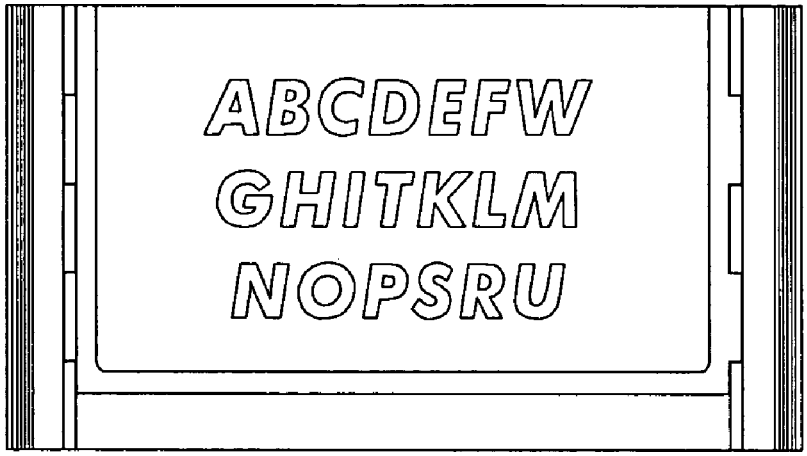
FIG. 34 is a front view of the FIG. 33.
Figure 35:
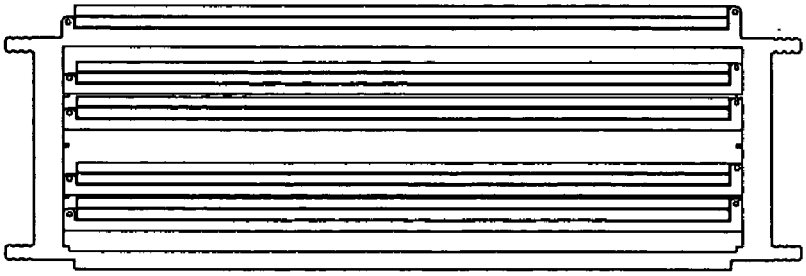
FIG. 35 is a bottom view of FIG. 34.

FIG. 33 is a top view of the card frame holder 260 with hinged card frames stored therein. FIG. 34 is a front view of the FIG. 33, and FIG. 35 is a bottom view of FIG. 34.

The invention can use and interchange any sign board of indicia as desired by the user. The sign indicia can include, but is not limited to text message(single words, phrases, slogans, and the like), symbols, logos, designs, sports team names and players and mascots and logos and symbols and designs, school names and players and mascots and logos and symbols and designs, and even advertisements of business services and products, and the like.

The components of the novel invention can be made from various materials such as but not limited to plastic, metal, combinations, thereof, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A portable interchangeable sign device, comprising:

a hollow main frame having a first pair of longitudinal interior channels facing one another, the main frame having at least one of a top opening and a bottom opening;

a first sign having visible indicia thereon for being slidable within the first pair of longitudinal interior channels from a storage position inside of the frame to an exterior position outside of the frame;

a second pair of longitudinal interior channels facing one another inside of the main frame;

a second sign having visible indicia thereon for being slidable within the second pair of interior channels from a storage position inside of the main frame to an exterior position outside of the frame, the first sign for being extended above the main frame, and the second sign be for being extendable below the main frame; and a pole extending downward beneath the main frame for allowing one hand of a user to support the main frame in a raised position.

2. The sign device of claim 1, further comprising:

a pair of catch slots in the top opening of the main frame adjacent to the first pair of longitudinal interior channels for allowing lower side edge tabs on the first sign to be held therein so that the first sign is attached to and extends above the main frame.

3. The sign device of claim 1, further comprising:

a pair of catch slots in the bottom opening of main frame adjacent to the first pair of longitudinal interior channels for allowing upper side edge tabs on the first sign to be held therein so that the first sing is attached to and extends below the main frame.

4. The sign device of claim 1, wherein the first sign includes:

a U-shaped subframe for supporting the first sign therein, the U-shaped subframe having upper side edge tabs for allowing the U-shaped subframe to slide within the longitudinal interior channels; and a sign board being slidably removable from the U-shaped subframe.

5. The sign device of claim 1, wherein the first sign includes:

a U-shaped subframe for supporting the first sign therein, the U-shaped subframe having lower side edge tabs for allowing the U-shaped subframe to slide within the longitudinal interior channels; and a sign board being slidably removable from the U-shaped subframe.

6. The sign device of claim 1, wherein the main frame includes:

a U-shaped front opening in the main frame for allowing the first sign to slide up and down therein.

7. A portable interchangeable sign device, comprising:

a hollow main frame having a first pair of longitudinal interior channels facing one another, the main frame having at least one of a top opening and a bottom opening;

a first sign having visible indicia thereon for being slidable within the first pair of longitudinal interior channels from a storage position inside of the frame to an exterior position outside of the frame; and at least one of a holder or a handle attached to the frame for allowing the sign device to be supported and held by a user;

a U-shaped subframe for supporting the first sign therein, the U-shaped subframe side edge tabs, selected from one of upper and lower side edge tabs, for allowing the U-shaped subframe to slide within the longitudinal interior channels; and a sign board being slidably removable from the U-shaped subframe.

* * * * *